US006073706A

United States Patent [19]

Niemi

[11] Patent Number: 6,073,706

[45] Date of Patent: Jun. 13, 2000

[54] HYDRAULICALLY OPERATED IMPACT DEVICE

[75] Inventor: Ilkka Niemi, Hollola, Finland

[73] Assignee: Tamrock Oy, Tampere, Finland

[21] Appl. No.: 09/281,319

[22] Filed: Mar. 30, 1999

[30] Foreign Application Priority Data

| | | | |
|---|---|---|---|
| Mar. 30, 1998 | [FI] | Finland | 980715 |
| Jan. 20, 1999 | [FI] | Finland | 990110 |

[51] Int. Cl.[7] ..... B25D 9/04

[52] U.S. Cl. ..... 173/206; 173/138; 173/208; 173/207

[58] Field of Search ..... 173/128, 138, 173/206, 207, 208, 135, 17, 137; 91/300, 303, 290, 321

[56] References Cited

U.S. PATENT DOCUMENTS

| | | | |
|---|---|---|---|
| 4,474,248 | 10/1984 | Musso | 173/17 |
| 4,646,854 | 3/1987 | Arndt et al. | 91/321 |
| 4,817,737 | 4/1989 | Hamada et al. | 173/207 |
| 4,899,836 | 2/1990 | Venot | 173/207 |
| 5,056,606 | 10/1991 | Barthomeuf | 173/208 |
| 5,392,865 | 2/1995 | Piras | 173/138 |
| 5,520,254 | 5/1996 | Weber | 173/206 |
| 5,890,548 | 4/1999 | Juvonen | 91/300 |

FOREIGN PATENT DOCUMENTS

| | | |
|---|---|---|
| 0 085 279 | 8/1983 | European Pat. Off. . |
| 0 426 982 A1 | 5/1991 | European Pat. Off. . |
| 844848 | 7/1985 | Finland . |
| 101522 | 6/1992 | Finland . |

*Primary Examiner*—Scott A. Smith
*Attorney, Agent, or Firm*—Nixon & Vanderhye P.C.

[57] ABSTRACT

The invention relates to a hydraulically operated impact device, such as a percussion hammer or some other breaking apparatus, comprising a control valve (6) for controlling pressure fluid supplied to and from the percussion piston (1) so that the direction of motion of the piston (1) can be changed in accordance with the cycle of operation of the impact device. According to the inventive idea, when the control valve (6) is in the impact position, the impact device is provided with a closed space that is partly bordered by the control valve and the percussion piston. The percussion piston (1) comprises a section which communicates with said space and which has a larger diameter than the upper end of the piston. The control valve and the percussion piston are thus able to move in the same direction until a connection is opened from this closed space to the upper end of the percussion piston (1).

8 Claims, 8 Drawing Sheets

HYDRAULICALLY OPERATED IMPACT DEVICE

BACKGROUND OF THE INVENTION

The invention relates to a hydraulically operated impact device comprising a frame and a percussion piston arranged to reciprocate in the frame due to the pressure fluid, the piston comprising at its upper end a cylindrical guide that has a smaller diameter than the greatest diameter of the percussion piston, the upper end of the guide comprising an impact pressure surface, the device further comprising an inlet duct and a return duct for supplying pressure fluid into and out of the impact device, a control pressure space situated near the upper end of the percussion piston, the guide of the percussion piston being arranged to enter said space substantially tightly at the end of the return motion of the piston, and a control valve for controlling the movement of the piston, the control valve closing in the return position the inlet duct for pressure fluid and opening the return duct, the control valve comprising a pressure surface that continuously communicates with the control pressure space, and a pressure surface that acts in the opposite direction and that is continuously connected to a pressure space situated further from said pressure space in the direction of impact of the percussion piston, the percussion piston closing the connection between said pressure surfaces of the control valve as it moves into the control pressure space and pushing the control valve from the return position to the impact position via the pressure fluid in the control pressure space, so that a connection is opened from the inlet duct for pressure fluid to said space, the pressure of the pressure fluid in the inlet duct acting on both the impact pressure surface of the percussion piston and said pressure surface of the control valve, causing the impact motion of the percussion piston.

Hydraulically operated impact devices, such as percussion hammers and other breaking apparatuses, are used for example to break relatively hard materials, including stone, concrete, asphalt, frozen soil, metal slag etc. For instance percussion hammers are usually installed as auxiliary equipment in excavators instead of buckets, but other base machines and carriers can also be used. Impact devices are usually operated by the hydraulics of the base machine. Correspondingly, hydraulically operated drilling machines comprising an impact apparatus are used to drill different rock materials.

An impact device comprises a hydraulically reciprocating percussion piston, which delivers successive blows via a tool at the object to be broken. Pressure fluid to and from the percussion piston is supplied by means of suitable ducts. The flow of the pressure fluid is guided to the operating space of the percussion piston according to the cycle of operation of the impact device for example by means of different spool valves and slides. However, the operation of known control means requires the supply of separate control pressure, which in turn requires the formation of complicated ducts and grooves that increase the number of leakages inside the device. Another problem of the present slides and other components operated by control pressure is the bypassing of the pressure fluid, in other words pressure fluid used for the control is released into a return duct of the pressure fluid circuit. This naturally causes unnecessary power consumption. Other prior art arrangements include different springs and other mechanical means for moving the control valve, but such arrangements are complicated, however, regarding both operation and manufacture, not to mention durability.

European Patent Specification 0,085,279 discloses a known arrangement for controlling the movements of the percussion piston. In this reference, the percussion piston is surrounded by a sleeve-like control valve, which controls the flow of the pressure fluid supplied to the percussion piston. In the apparatus according to the reference, when the upper section of the percussion piston forces its way into the sleeve as the piston rises, the upper surface of the sleeve is subjected to a pressure which makes the sleeve move downwards, whereupon a connection to a high-pressure duct is opened and high pressure starts acting on the upper end of the percussion piston, pressing it downwards to deliver an impact. The high pressure simultaneously acts on the upper surface of the sleeve, pressing it downwards all the way to its lower position. When the uppermost section of the percussion piston emerges from the sleeve, the same high pressure that pushes the percussion piston downwards starts acting on the surfaces at the lower part of the sleeve. The size of the pressure surface at the sleeve's lower end is greater than the size of the pressure surface at the upper end, which means that the sleeve starts moving upwards, closing again in its upper position the connection to the high-pressure duct. However, a problem of this arrangement is that the control valve strikes either the components bordering its area of movement or the bottom, which may damage the structure and cause unnecessary wearing in the long run.

SUMMARY OF THE INVENTION

The purpose of the present invention is to provide a hydraulically operated impact device which avoids the prior art drawbacks and which is economical to manufacture and use.

The impact device according to the invention is characterized by the control valve closing in the impact position the connection to the return duct so that a closed pressure fluid space is formed, the space being partly bordered by the guide of the piston and the control valve, the percussion piston comprising a second section which is situated below the guide and which has a greater cross-sectional area than the guide, said second section in turn bordering said closed pressure fluid space, the percussion piston thus moving in the direction of impact and, correspondingly, the control valve continuing its movement from the return position towards the impact position over a section of the length of the impact motion, the pressure of the pressure fluid acting on the control valve being transmitted, via the control valve and the pressure fluid in the closed space, to act on the percussion piston in the impact direction thereof, the speeds of motion of the percussion piston and the control valve being thus inversely proportional to the ratio of the difference between the cross-sectional areas of the sections of the piston to the area of the total pressure surface of the control valve facing said closed pressure space.

A basic idea of the invention is that when the control valve closes the connection to the return duct for pressure fluid, a closed space is formed, partly bordered by the control valve and the percussion piston. At the beginning of the impact motion of the percussion piston, the control valve and the piston move in the same direction so that the ratio of the rates of motion of the percussion piston and the valve is inversely proportional to the ratio of the area of a pressure surface of the percussion piston facing the closed space to the area of a pressure surface of the control valve facing the closed space. The basic idea of a preferred embodiment of the invention is that the control valve is a sleeve-like element which is placed coaxially around the percussion piston and which is arranged to reciprocate in a cylindrical space.

Inside the valve is formed a cylindrical pressure space which corresponds substantially tightly to the guide section of the percussion piston, so that the cylindrical guide section of the rising percussion piston can force its way into the cylindrical space, displacing the pressure fluid in the space and making the sleeve-like control valve move downwards. The combined area of the pressure surfaces of the control valve facing the closed space is greater than the difference between the area of the guide section of the percussion piston and the area of the section of the piston with the greatest diameter connected to the closed space, which means that the control valve moves more slowly in the direction of impact than the percussion piston. Further, the basic idea of another preferred embodiment is that the control valve is a spool-like element the upper end of which is hydraulically connected to a cylindrical space formed in the frame, corresponding tightly to the guide section of the percussion piston. Thus, when the percussion piston moves to the upper position and pushes its way into this space, the pressure fluid displaced by the percussion piston is arranged to move the spool downwards.

The invention has an advantage that the structure of the impact device can be made more simple than previously, which is advantageous not only to the manufacture but also to the maintenance of the device. Furthermore, the cylinder surrounding the percussion piston or the piston itself do not have to be provided with control pressure grooves, nor does the frame require complicated bores for implementing the control. This also simplifies the structure and reduces the costs of manufacture. All in all, the structure of the impact device according to the invention is simple and comprises only a few moving parts that are liable to wearing, which makes it economical to manufacture, easy to maintain and endurable in use. Another advantage is that it is easy to make the flow distances of the high pressure fluid short so that pressure losses remain small. A further advantage of the impact device according to the invention is that the control valve can be prevented from hitting the bottom of the space where the control valve moves. It is also a great advantage that at the acceleration stage a force is generated jointly by the pressure surface of the piston and the pressure surface of the control valve, so that the percussion piston accelerates more rapidly and a higher impact power is obtained with the same pressure.

It should be mentioned that in the present application and the claims, in connection with the device or the components thereof, the definition "lower end" refers to the end of the impact device facing the tool, and "upper end" correspondingly refers to the opposite end of the impact device.

BRIEF DESCRIPTION OF THE DRAWINGS

The invention will be described in greater detail in the accompanying drawings, in which.

DESCRIPTION OF THE PREFERRED EMBODIMENT

Figure 1B:
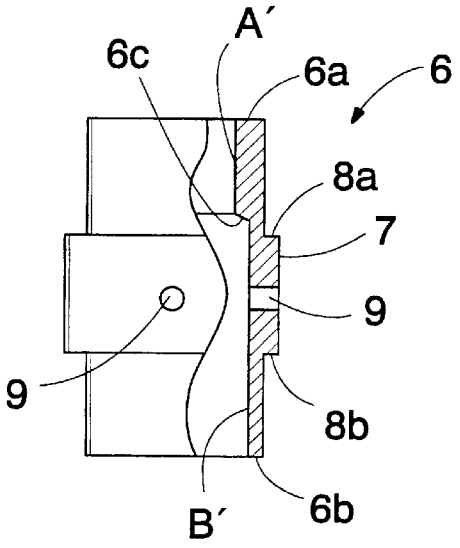
FIG. 1*b* is a schematic side view, in a partial section, of a possible structure of a control valve.
Figure 1A:
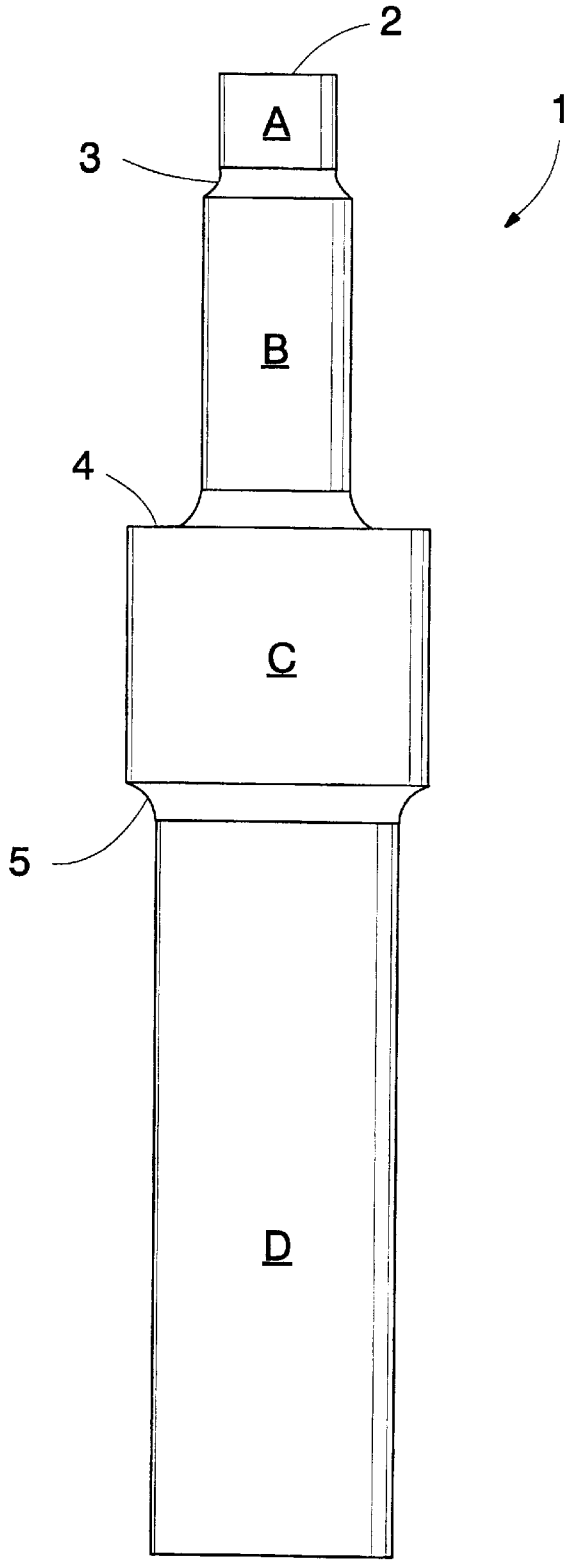
FIG. 1*a* shows schematically, in a side view, a percussion piston of an impact device according to the invention.

FIG. 1*a* is a side view of a possible structure of a percussion piston. The percussion piston 1 comprises, starting from the top of the piston, coaxial cylindrical sections which include a first section or a guide A, a second section B, a third section C and a fourth section D. The diameter of guide A is the smallest. At the upper end of the piston at the end of guide A there is an impact pressure surface 2, which is subjected to the pressure of the pressure fluid that makes the percussion piston move in the direction of impact. Guide A is followed by the second section B. The diameter of section B is greater than the diameter of section A, and between sections A and B there may be an upper shoulder 3 of the percussion piston. Section B is further followed by section C of the percussion piston, which has in turn a greater diameter than section B, so that a middle shoulder 4 of the percussion piston is provided between sections B and C. Correspondingly, between section C and section D, which has the smaller diameter of the two, there is a pressure surface or lower shoulder 5 which causes the return motion of the piston and which receives the high pressure fluid for moving the piston 1 to the upper position preceding an impact. The impact pressure surface 2 of the percussion piston in turn receives the high pressure fluid when the piston is pushed from its upper position towards the tool in order to deliver an impact. The area of the impact pressure surface of the percussion piston is clearly greater than the pressure surface area of the lower shoulder, which means that the percussion piston can be made to move rapidly downwards by means of the pressure applied at the upper end, even though in this embodiment the lower shoulder is constantly subjected to a high pressure and a force lifting the piston. Alternatively, pressure fluid with a suitable pressure can be applied to the middle shoulder 4, in which case the area of the impact pressure surface 2 may be smaller than the area of the lower shoulder 5 when the pressure of the pressure fluid remains the same. The pressure of the pressure fluid acting on the middle shoulder 4 creates a force that tries to move the percussion piston in the direction of impact.

Figure 2:
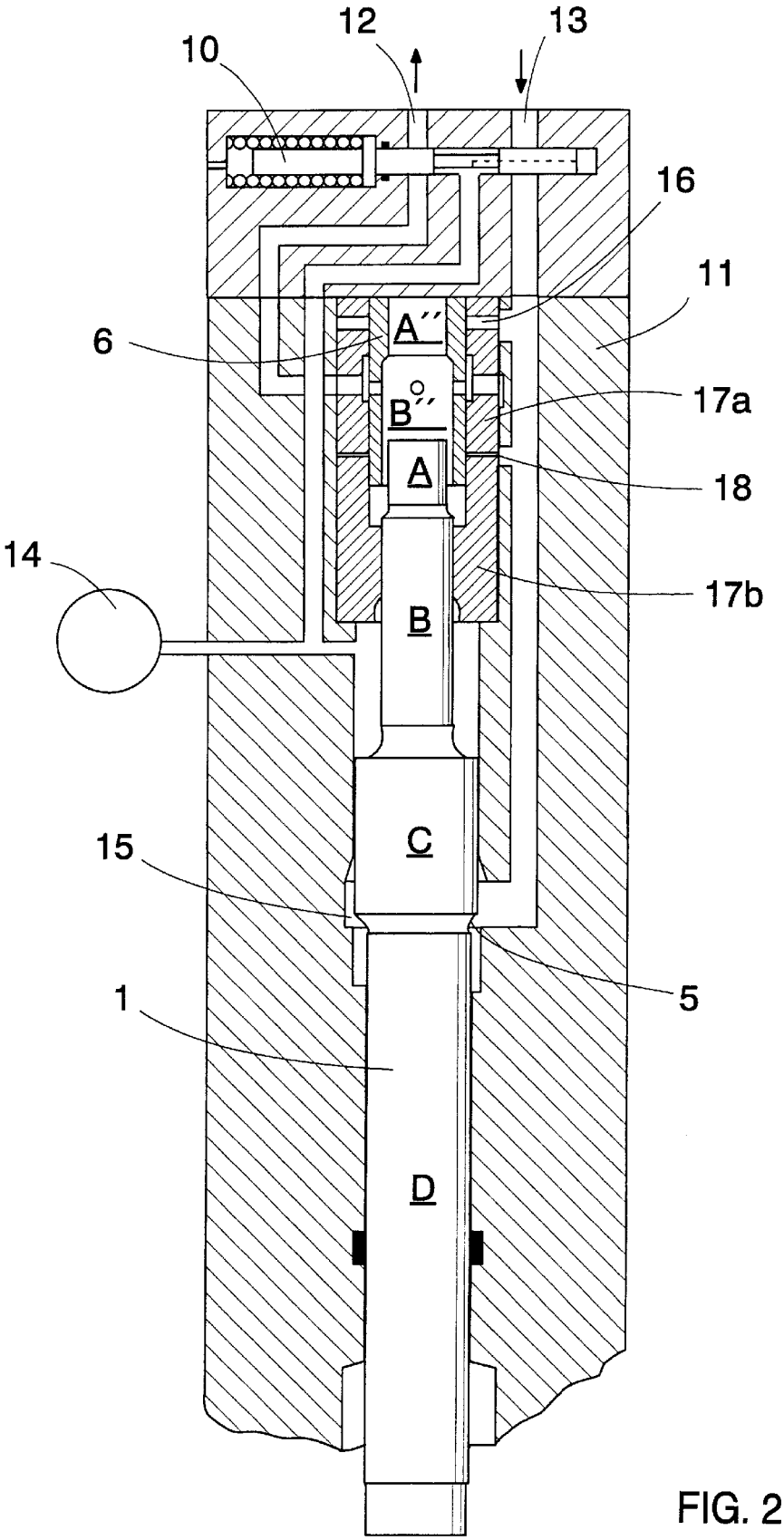
FIG. 2 is a schematic sectional side view of an impact device according to the invention.

FIG. 1*b* is a side view, in a partial section, of a possible structure of a control valve 6. The valve 6 shown in the figure is a sleeve-like element, which is arranged to guide the pressure fluid used by the percussion piston by means of the up-and-down movement of the valve. The control valve thus guides the movements of the percussion piston in accordance with the cycle of operation by alternating the high pressure and the pressure of the return line to act on the upper end 2 and on the upper shoulder 3 of the percussion piston. The other end of the control valve, which in this embodiment means the upper end, comprises an upper pressure surface 6*a*, and the opposite end comprises lower pressure surfaces 6*b* and 6*c* the combined area of which equals the area of the pressure surface 6*a*. The frame of the impact device or preferably a separate block arranged in the frame as shown below in FIG. 2 is provided with a cylindrical space for the control valve, which is able to reciprocate in the space. The outer surface of the sleeve-like control valve 6 is provided in the middle with an enlargement 7 which has a greater diameter than the ends of the valve, so that the outer surface comprises substantially equal upper and lower shoulders 8*a* and 8*b* between the enlargement and the upper end of the sleeve, and the enlargement and the lower end of the sleeve. For the sake of clarity, the enlargement and the shoulders are shown in an exaggerated manner in the figure. In practice, a sufficient difference between the diameter of the ends and the diameter of the enlargement is only a few millimeters or even less. The shoulder 8*a* on the side of the upper pressure surface 6*a* of the control valve is arranged to be in continuous contact with the return duct for pressure fluid, and correspondingly the shoulder 8*b* on the side of the lower pressure surface 6*b* is arranged to be in contact with the inlet duct for pressure fluid or with some other duct having a higher pressure than the upper end. When the impact device is being used, a high pressure fluid acts on the inlet duct, whereupon the control valve 6 can be subjected, by means of the shoulders 8*a* and 8*b*, to a force that continuously lifts the valve during the use of the impact device. Further, at the enlargement 7 there are one or more conduits 9 leading from the outer circumference of the control valve into the valve for conveying pressure fluid to the return duct for pressure fluid. The inner surface of the control valve comprises, from the top, a first section A' that forms a tight fit with guide A of the percussion piston 1. The next section following section A' in the direction towards the percussion piston is a second section B', the diameter of which is greater than the second section B of the percussion piston. Therefore, section B of the percussion piston fits loosely in section B' of the valve, which means that the connection from the space below the sleeve to the return duct is kept open despite the upward motion of the piston, as will be shown below.

FIG. 2 shows an impact device according to the invention comprising a sleeve-like control valve 6. The structure of the impact device will be described herein regarding only the components that are essential to the invention, since the basic structure of the device should be evident to those skilled in the art. In the arrangement according to the figure, the cover of the impact device is provided with a pressure regulating valve 10, but the valve can also be placed on a frame 11 of the impact device or in some other suitable place. The pressure regulating valve 10 is arranged to control the charging of a pressure accumulator 14 in the low pressure circuit of the impact device. The pressure accumulator can be filled with pressure fluid that can be used later during the cycle of operation. The pressure accumulator can thus be used to even out the flows of the pressure fluid and to balance pressure variations. The upper end of the impact device further comprises connections for a return duct 12 for pressure fluid and for an inlet or high pressure duct 13. The connection from the high pressure duct 13 is constantly open to a pressure space 15 formed at the lower shoulder 5 of the percussion piston and to the lower shoulder 8*b* of the control valve 6 via a control conduit 18. For the sake of clarity, FIG. 2 does not show the shoulders 8*a* and 8*b* of the control valve. During an impact, there is a connection 16 from the high pressure duct to a control pressure space A" situated inside section A' of the control valve 6. During the cycle of operation, the lower shoulder 5 of the percussion piston is constantly subjected to a high pressure that tends to lift the piston to the upper position. In accordance with the cycle of operation, the control valve guides the high pressure to act on the impact pressure surface 2 of the percussion piston in order to make the piston 1 perform an impact motion. The return duct 12, in turn, leads approximately to the middle of the cylindrical space formed for the control valve. The sleeve-like control valve 6 is arranged coaxially with the percussion piston in the upper end thereof, so that guide A provided in the piston may move substantially tightly into the pressure space A" provided in the control valve. The control valve is arranged to move in the axial direction of the percussion piston in a cylindrical space formed in a preferably separate sleeve-like block placed immovably in the frame. For the purpose of installing the control valve comprising shoulders, the block consists of two separate blocks placed one on top of the other as shown in the figure: a first block 17*a* and a second block 17*b*. The first block comprises on its inner circumference a cylindrical space for the sleeve and ducts that are necessary for pressure fluid. The second block also comprises a cylindrical space for the lower part of the control valve, the lower end of the block further comprising a tight opening for section B of the percussion piston. The connecting surface between these blocks is preferably provided with a control conduit 18, which is continuously in contact with the inlet duct 13. The device may comprise one or several control conduits, depending on how the flow and supply of the pressure fluid to different parts of the device are implemented. The blocks are formed such that the control valve with shoulders is able to move in the up-and-down direction and that the high pressure fluid supplied from the control conduit cannot flow to the return duct at any stage. The blocks that are separate from the frame are advantageous since they can be replaced easily if necessary. Also, it is easier and cheaper to machine the required shapes and sealing surfaces in separate blocks than in a large basic frame.

Figure 3A:
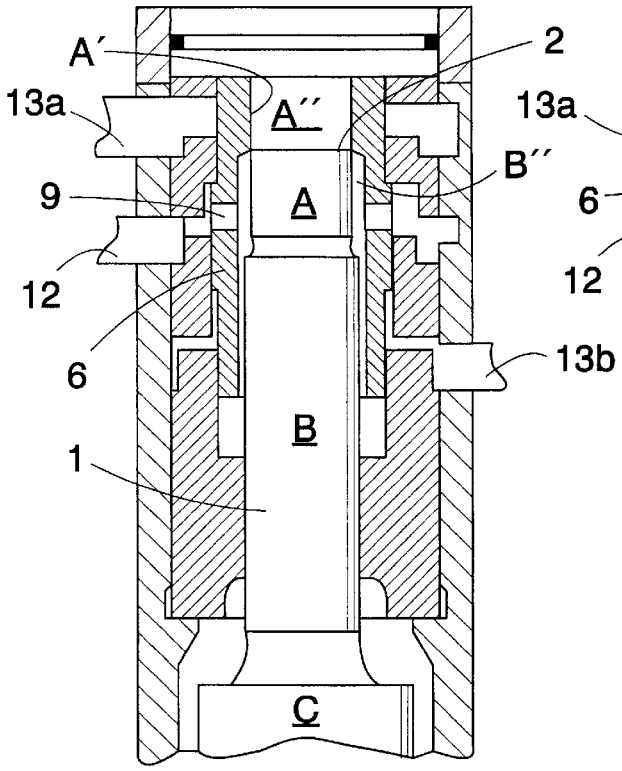
FIGS. 3*a* to 3*c* show schematically, in a simplified form, the phases of the cycle of operation of the impact device of FIG. 2 from the lift of the percussion piston to the delivery of the impact.
Figure 3B:
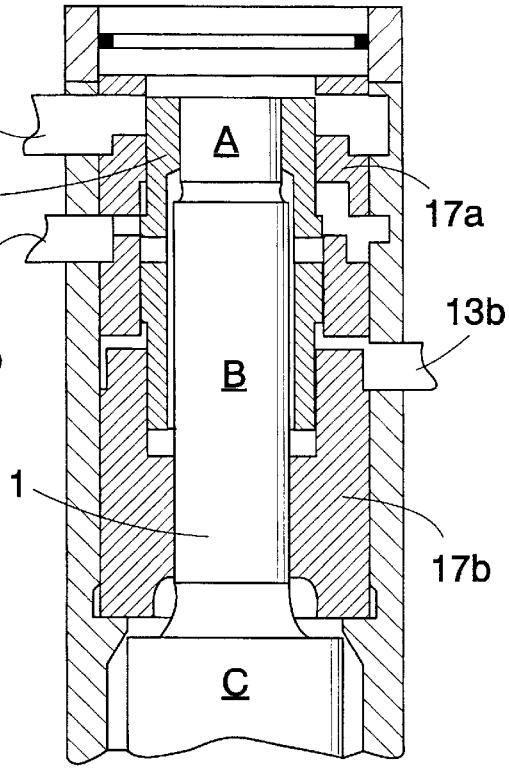
Figure 3C:
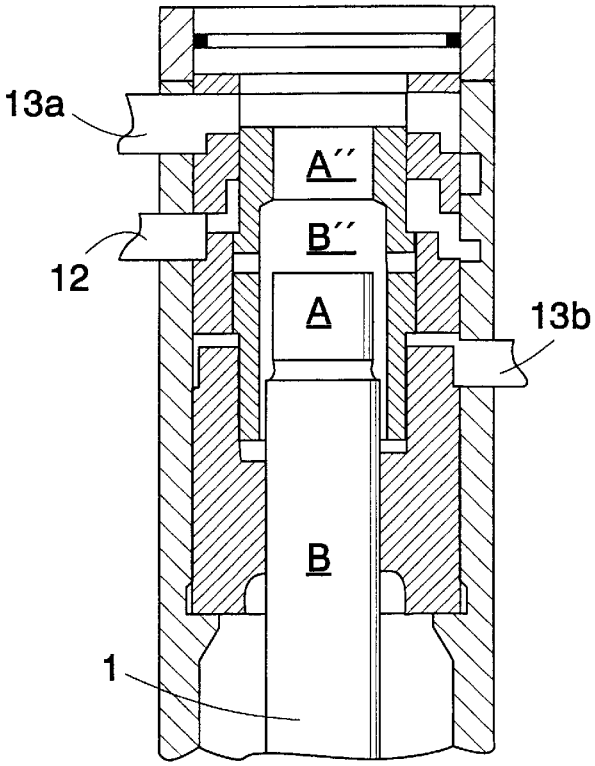

FIGS. 3*a* to 3*c* show the general features of a part of the impact device according to the invention in a sectional side view. The parts that are not essential to the invention are shown in a simplified form in the figures. The impact device is activated by supplying pressure fluid from the inlet duct to the lower shoulder of the percussion piston. Pressure fluid is simultaneously applied, by means of a pressure regulating valve not shown in the figures, to the low pressure circuit, whereupon the pressure accumulator is charged. The lower shoulder 8*b* of the control valve 6 is always subjected to the high pressure in the inlet duct, and the upper shoulder 8*a* is always subjected to the pressure in the return duct. Therefore, the control valve is set in the upper position or return position, where it closes the connection from the upper section A" of the pressure space to the inlet duct 13*a*. The interior of the control valve is connected to the return duct 12 by means of conduits 9 provided in the sleeve, wherefore the impact pressure surface 2 of the percussion piston is only subjected to the pressure of the return line, in other words the space is substantially nonpressurized. The percussion piston 1 thus moves upwards due to the high pressure acting on the lower shoulder 5 of the piston, simultaneously pushing the pressure fluid ahead to the return duct via the transverse openings 9 formed in the valve 6. When the percussion piston has been lifted to the position shown in FIG. 3*a* where the upper end 2 of the piston is at the same level with the lower edge of the pressure space A" of the control valve, the connection between the impact pressure surface 2 of the percussion piston and section B is closed. In such a case, a closed pressure space is formed above the impact pressure surface 2 of the percussion piston, this space being filled with pressure fluid. Since the pressure fluid is substantially incompressible, the volume of the pressure space must remain constant. Therefore, the control valve 6 starts moving downwards while the percussion piston keeps on rising. The percussion piston and the control valve thus move in opposite directions. At the same time, the upper shoulder of the percussion piston and the control valve that moves downwards push the pressure fluid to the return duct 12 via the opening 9.

In FIG. 3*b*, the percussion piston 1 is in the upper point of inversion or in its upper position, from which it is pushed by the pressure fluid towards the tool at a high speed. The control valve 6 has moved downwards to such an extent that the connection to the inlet duct 13 for pressure fluid is opened, whereupon high pressure fluid can flow to the pressure space above the impact pressure surface 2 of the percussion piston. The high pressure can now act on the upper surfaces of both the control valve and the percussion piston. Due to this pressure, the control valve 6 moves further downward towards the lower position, and the percussion piston starts simultaneously its impact motion, in other words the piston starts moving downwards at a high speed in order to deliver an impact at the upper end of the tool. Simultaneously, the control valve that moves downwards closes the connection from the space bordered by the percussion piston 1 and section B' of the control valve to the return line 12. Since a closed pressure fluid space B" is thus formed between the percussion piston and the control valve, the space neither releasing nor receiving substantially any pressure fluid, the downward movement of the control valve is only possible since during the downward movement of the percussion piston the wider section B of the piston moves away from the closed space while the narrower end of the piston moves further into the space increasing the volume thereof. Consequently, the control valve may move downwards and displace pressure fluid from the space below it in an amount corresponding to the increase of volume. Another result is than when the diameters of the control valve and the percussion piston are adjusted suitably, the downward speed of the percussion piston may be greater than the speed of the control valve. When a sleeve-like control valve is used as shown in FIGS. 3*a* and 3*b*, the combined area of the pressure surfaces of the control valve facing the closed space must be greater than the difference between the area of the guide of the percussion piston and the area of the section with the greatest diameter facing the closed space, in order that the percussion piston would move faster than the control valve and could thus move out of the space A' provided in the control valve. In such a case, the speed of motion of the percussion piston is already high and the piston continues its accelerating movement downwards and strikes the tool after guide section A of the piston emerges from section A' of the control valve 6 so that a connection is opened from the pressure space A" to the space below the control valve 6. The valve stops at the lower position as the percussion position continues its downward movement. When the control valve and the percussion piston move simultaneously downwards, the high pressure fluid acts both on the impact pressure surface 2 of the percussion piston and on the upper pressure surface 6*a* of the control valve as described above. The pressure of the pressure fluid acting on the upper pressure surface 6*a* of the control valve produces a force which is transmitted via the control valve to the aforementioned closed pressure space and from there via the upper shoulder 3 of section B of the percussion piston to the piston, producing thus an additional force on the piston. Therefore, the force accelerating the percussion piston is far greater than the mere force produced by means of the impact pressure surface 2 of the piston. When the control valve starts moving upwards, it closes again the connection to the inlet duct 13*a* and correspondingly opens a connection to the return duct 12, whereafter the upper end of the percussion piston is subjected to the pressure of the return line. Since the lower shoulder 5 of the percussion piston 1 is continuously subjected to the high pressure in the inlet line, the piston keeps rising all the way to the upper point of inversion. After the lift of the percussion piston, the cycle of operation described above is repeated until the supply of pressure fluid to the impact device is interrupted.

Figure 4A:
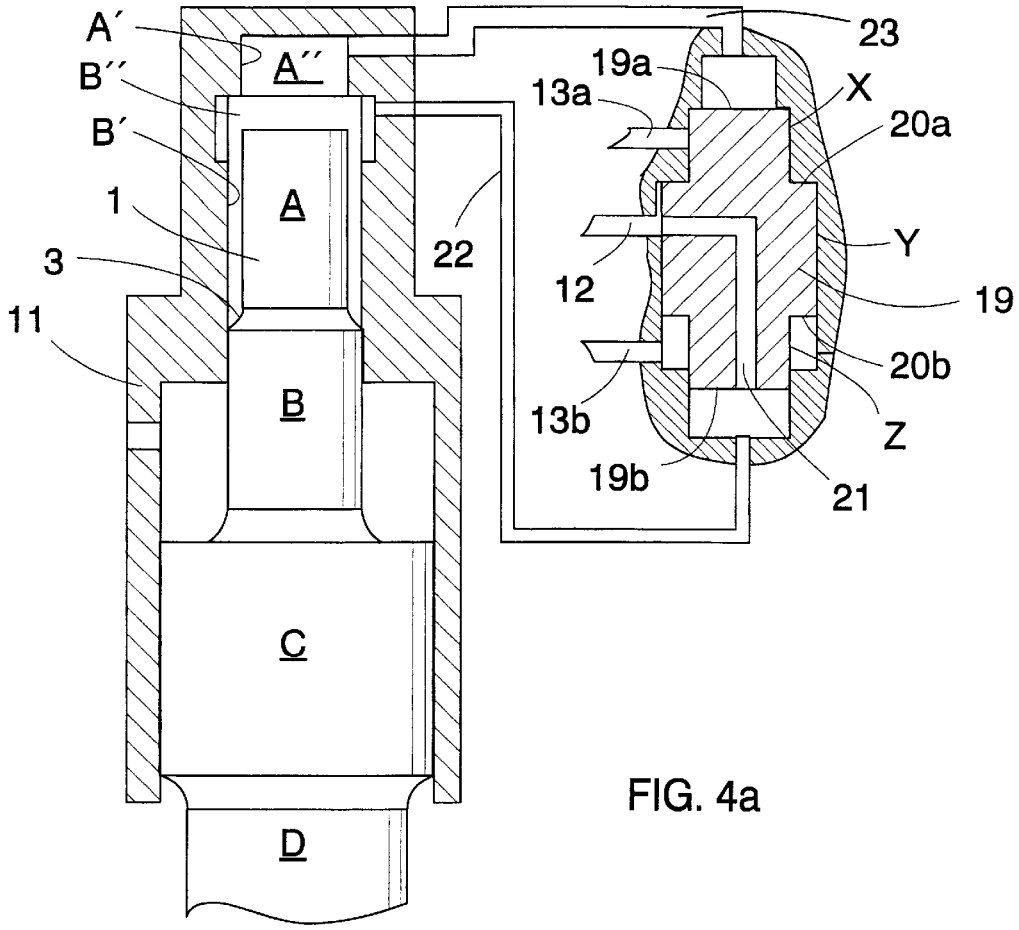
FIGS. 4*a* and 4*b* show schematically other possible impact devices according to the invention.

FIG. 4*a* is a simplified general view of another part of the impact device according to the invention where the control valve is a spool-like reciprocating slide. This type of control valve can be placed rather freely in a desired place in the impact device. However, in view of pressure losses it is most preferable to place the valve as close to the upper part of the percussion piston as possible so that the pressure fluid does not have to be moved over long distances. An advantage of such an arrangement is that the control valve is a component that is separate from the rest of the structure, whereby it is easy to manufacture and simple to replace. It operates similarly as the above-described sleeve-like slide. Thus, the control valve 19 is a spool which is arranged to reciprocate in a cylinder space provided in a suitable frame, the spool comprising, from the top of the figure, sections X, Y and Z. The outer diameters of sections X and Z are preferably substantially equal. The diameter of section Y is in turn greater than the spool ends, which means that an upper shoulder 20*a* of the spool is formed between sections X and Y, and correspondingly a lower shoulder 20*b* is formed between sections Y and Z, the areas of the shoulders being substantially equal. In a similar manner as in connection with the sleeve-like control valve, the lower shoulder 20*b* is subjected to a constant high pressure and the upper shoulder 20*a* is subjected to a pressure of the return line, which is usually close to zero. Due to the different pressures acting on the shoulders of equal size, the control valve 19 is constantly subjected to a force that pushes it upwards. Further, the lower end of the control valve is provided with a conduit 21 which communicates with the return duct 12 when the control valve 19 is in the upper position. An upper pressure surface 19*a* at the upper end of the control valve 19 is connected to a pressure surface A' above the percussion piston 1, and a lower pressure surface 19*b* provided at the lower end of the spool is connected to a side conduit 22. Between guide A of the percussion piston and the cylindrical pressure space A' formed in the frame of the impact device there is a substantially tight fit. Section B' formed in the frame 11 is also substantially tight with respect to section B of the percussion piston. When high pressure is supplied to the lower shoulder 5 of the percussion piston 1, the piston starts ascending to its upper position. The control valve 19 is thus in its upper position due to the high pressure acting on the lower shoulder 20*b* of the valve. When the control valve 19 is in the upper or return position, it closes the connection to the upper inlet duct 13*a* but opens a connection from section B' of the frame to the return duct 12 via the side conduit 22 and the conduit 21. When guide section A of the percussion piston enters the pressure space A" of the frame, a pressure space B" is formed between guide A, section B' of the frame and the shoulder 3, this space being connected via the conduit 22 to the pressure surface 19*b* of the control valve, and via the conduit 21 that passes through the valve 19 to the return duct 12. The upward movement of the percussion piston 1 requires the flow of the pressure medium from the aforementioned space to the return duct 12. Further, when guide A of the percussion piston enters the pressure space A' of the frame, the control valve starts moving downwards in the figure due to the pressure fluid displaced by the percussion piston. A connection is then opened to the inlet duct 13*a*, and the high pressure medium is able to flow to the space above the control valve 19, pressing the valve downwards. When the control valve has moved a certain distance downwards the connection to the duct 12 is closed, thus resulting in a closed pressure space B" which is bordered by section B' of the frame, guide A of the percussion piston, the second section B, the shoulder 3, the side conduit 22, the pressure space below the spool, and the conduit 21 of the control valve. After the duct 12 has been closed, the percussion piston and the control valve 19 must move at a certain speed with respect to each other in order that the downward movement of the control valve 19 is possible. The pressure fluid can simultaneously flow via the space above the spool along a pressure fluid duct 23 to act on the upper end of the percussion piston, whereupon the piston starts an accelerating downward movement towards the tool. After the impact, the control valve and the percussion piston are lifted again and the cycle of operation of the impact device continues automatically under the control of the control valve until the supply of the pressure fluid to the impact device is cut off.

Figure 4B:
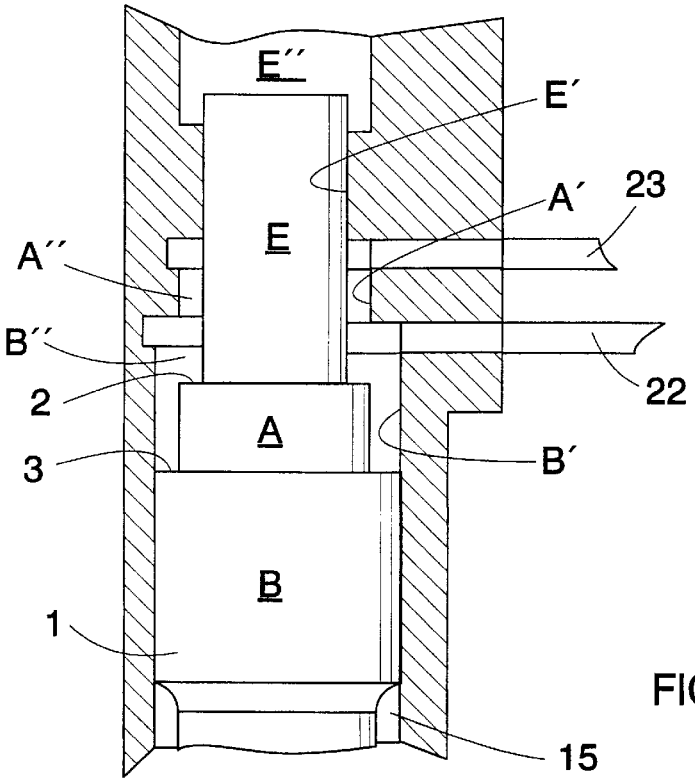

FIG. 4*b* shows another possible structure of the impact device. The control valve is not shown in the figure, but it is possible to use for example a similar control valve as shown in the preceding figure or the control valve structure shown below in FIG. 5*a* or 5*b*. The device operates as described above. The difference is that in this embodiment guide A is not situated uppermost in the percussion piston, but it forms an annular section for example in the middle of the piston. The upper part of the percussion piston may consist of a cylindrical section E which is arranged to move through a section E' provided in the frame into a pressure space E" as the percussion piston rises, thus forming a pressure accumulator at the upper end of the percussion piston. However, in a corresponding manner section A of the percussion piston forms a fit with section A' provided in the frame, in other words with the pressure space A".

Figure 5A:
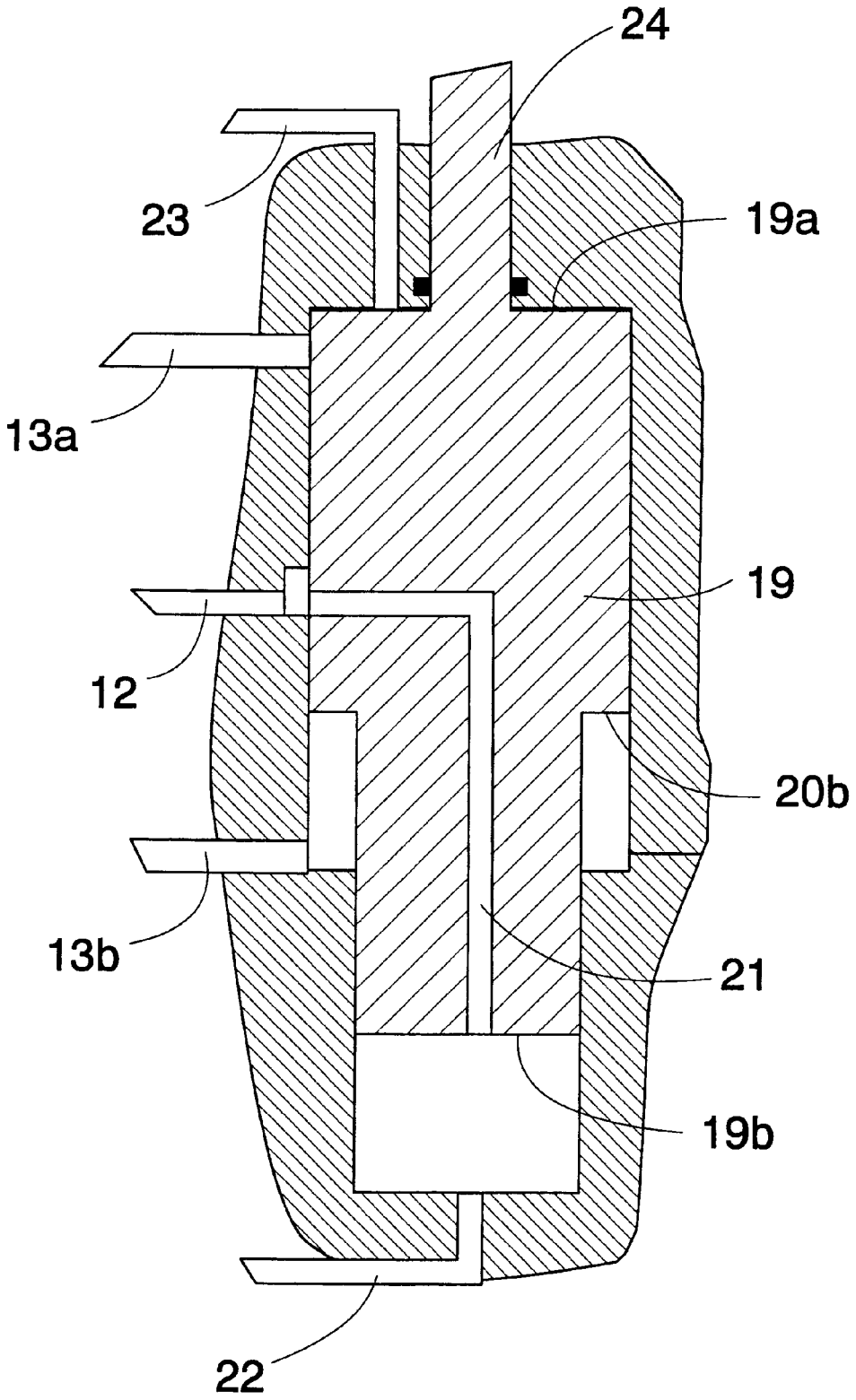
FIGS. 5*a* and 5*b* are schematic sectional views of spool-type control valves according to the invention.

FIG. 5*a* shows in a very simplified form the structure of an alternative spool-type control valve. In this structure, the control valve 19 comprises only one shoulder 20*b* and no upper shoulder. The area of the upper pressure surface 19*a* at the upper end of the control valve is made equal in size with the lower pressure surface 19*b* of the control valve by means of a peg 24. There are thus several manners of making the areas of the opposite ends of the control valve equal in size, if it is considered necessary when dimensioning the apparatus.

Figure 5B:
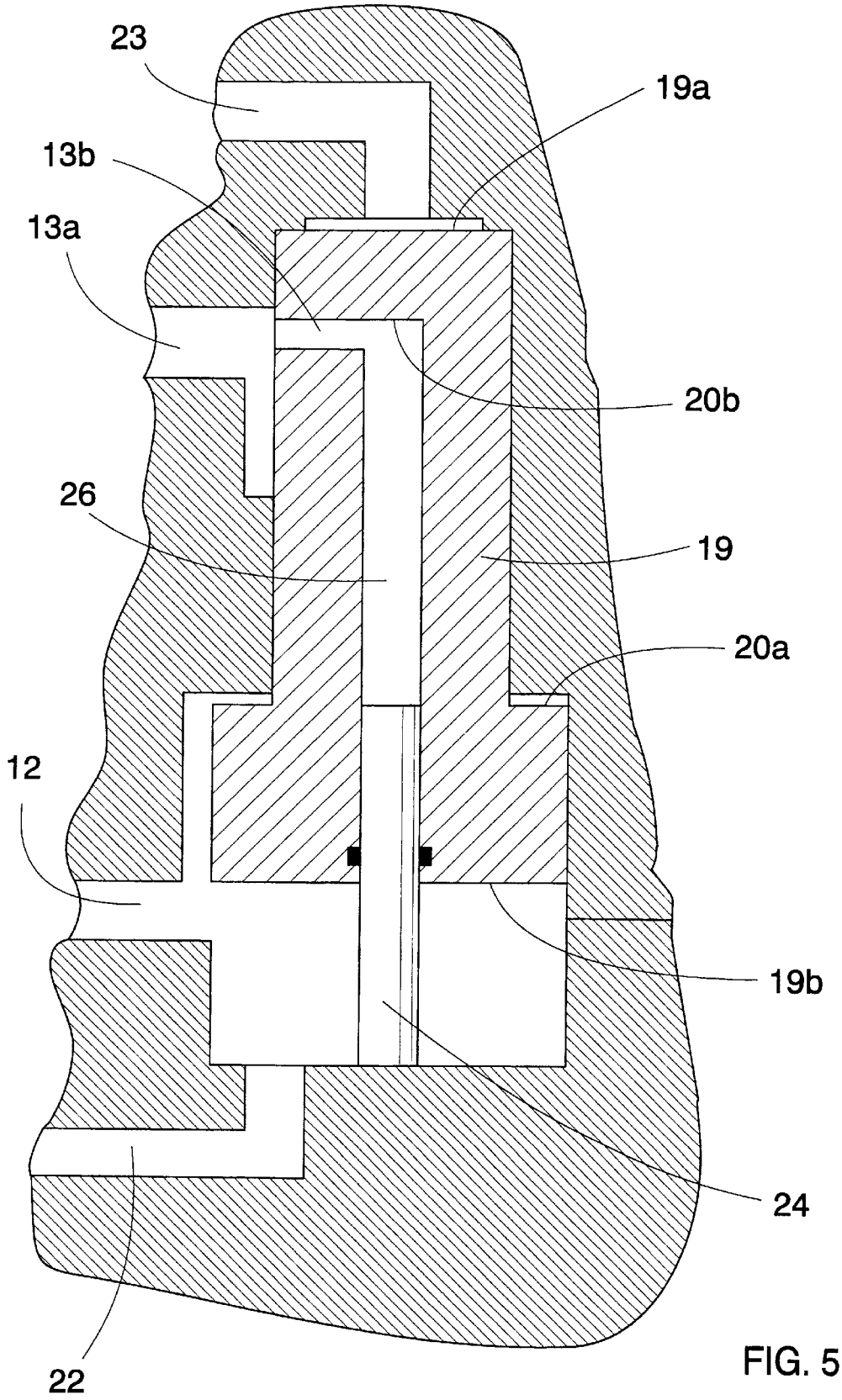

FIG. 5*b* is a sectional side view of a possible structure of the control valve. As in the preceding figure, the control valve resembles a spool and operates according to the inventive idea. In this embodiment, the diameter of the lower end of the control valve 19 is greater than the diameter of the upper end thereof. Further, the control valve 19 is provided with a duct 13*b*, which is in continuous contact with a high pressure duct 13*a*. This duct is closed off from the lower end of the control valve substantially tightly by a peg 24, which is placed preferably immovably in a pressure space below the control valve 19. The control valve 19 is arranged to move with respect to the peg 24. A duct 26 and the peg 24 border the closed pressure space which is subjected to a continuous high pressure, whereupon the upwardly directed pressure surface 20*b* of the duct is subjected to a high pressure that tries to lift the control valve 19 into a position that would cause a return motion of the percussion piston. The upper and the lower pressure surface 19*a* and 19*b* of the control valve 19 are arranged preferably equal in size by means of the peg 24, so that when the pressure in the duct 23 and the conduit 22 is substantially equal, the control valve 19 is subjected via the aforementioned pressure surfaces to substantially equal but opposite forces that cancel each other out. Also, in the control valve structure shown in the figure, the downward movement of the control valve produces a closed space. When the control valve 19 has moved a certain distance downward due to the pressure medium displaced by the percussion piston acting on the upper end 19*a* of the valve, the wider lower end closes the connection from the space below the valve to a discharge conduit 12. Thereafter the control valve can move further downward only if pressure medium can flow out via the conduit 22. This in turn requires that the closed pressure space with which the conduit 22 communicates expands due to the impact motion of the percussion piston.

Figure 6:
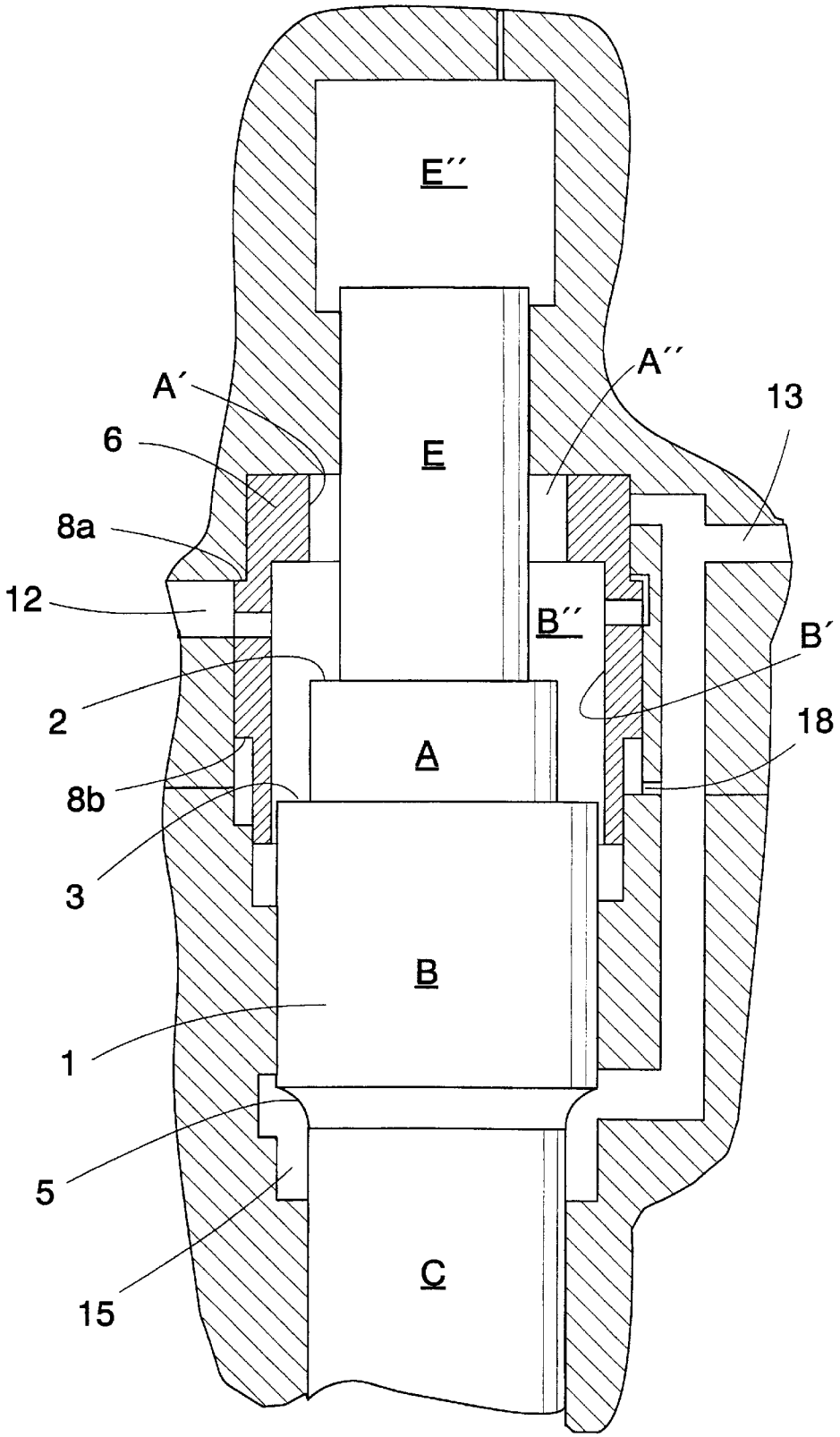
FIG. 6 is a schematic sectional side view of a slide-controlled impact device.

FIG. 6 is a cross-sectional side view of another possible structure. This arrangement also operates as shown in the preceding figures and disclosed in the invention. In the arrangement shown in FIG. 6, a sleeve-like control valve 6 is used to alternate a high pressure and a pressure of the return duct in an annular shoulder 2 of guide A of the percussion piston 1 and in a shoulder 3 of section B. A shoulder 5 is constantly subjected to a high pressure. The figure also shows a section E which is uppermost in the percussion piston. Above the section there may be an empty space E" to which section E can force its way when the percussion piston moves upward. Alternatively, the upper part of section E may also be provided with a pressure accumulator. Section E and the pressure space E" situated above it are not necessarily needed at all.

Figure 7:
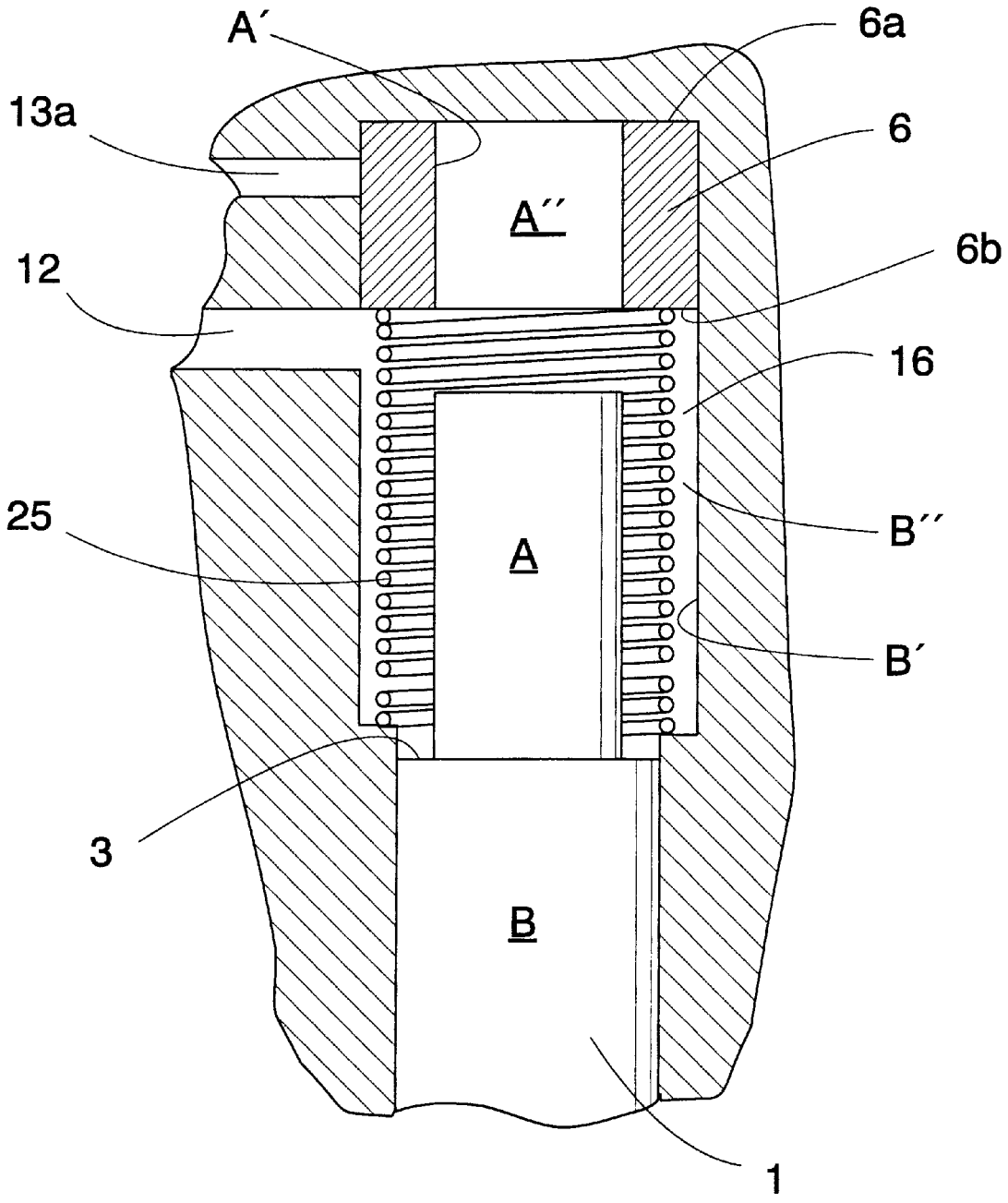
FIG. 7 is a schematic sectional view of a structure of the impact device according to the invention.

FIG. 7 shows yet another possible structure of the impact device according to the invention. The impact device of FIG. 7 corresponds otherwise to what is disclosed in connection with the preceding figures, except that now the sleeve-like control valve 6 is not subjected to a lifting force resulting from the pressure medium and the separate pressure surfaces, but a spring 25 is arranged to move the control valve into a position corresponding to the return motion of the percussion piston. The spring may also be some other type of flexible means than the one shown in the figure. The impact device according to the figure operates such that when guide A of the percussion piston 1 enters the pressure space A" of the control valve 6 and forms with section A' a substantially pressure-tight fit, the control valve 6 starts moving downwards in the figure, simultaneously compressing the spring. When the percussion piston continues moving upwards and the control valve moves in the opposite direction, a connection is opened to the high pressure duct 13*a*, whereupon the high pressure medium is able to act on both the control valve and the upper pressure surfaces of the percussion piston, pressing both downward. The descending control valve closes the connection to the return duct 12, which results in the formation of a closed pressure space B" which is bordered by the percussion piston, the frame and the control valve. The percussion piston continues its accelerating movement ending in an impact and the control valve keeps on moving downwards. The downward movement of the control valve requires that as the percussion piston moves downwards, the shoulder surface 3 makes space for the pressure fluid displaced by the control valve. When guide A of the percussion piston emerges from the pressure space A" of the control valve 6, substantially equal forces act thereafter on the pressure surfaces 6*a* and 6*b* of the control valve that are substantially equal in size. The spring thus presses the control valve 6 into an upper position corresponding to the return motion of the percussion piston, the control valve closing in this position the connection to the high pressure duct 13*a* and opening a connection to the return duct 12.

The drawings and the related description are only intended to illustrate the inventive idea. The details of the invention may vary within the scope of the claims. The percussion piston does not necessarily have to comprise a separate pressure shoulder which is connected to the closed space that is formed during the impact motion between the control valve and the percussion piston. Instead, it is sufficient that the diameter of the percussion piston changes over the section of the piston communicating with the closed space such that the diameter of the guide is smaller than the diameter of the widest section of the percussion piston connected to the aforementioned closed space during the impact motion and situated further in the direction of impact. The percussion piston may also comprise several different diameters one after another, even though such a structure is more expensive to manufacture and does not necessarily provide any essential advantage. The dimensions of the different sections of the control valve and the percussion piston, as well as the position of the pressure fluid ducts, are naturally arranged according to the requirements of the operation. However, an arrangement with two different diameters makes it possible to adjust the movement and speed of motion of the control valve and thus to dampen sudden blows directed at the valve especially when the valve is a sleeve-like element, and to provide reliable and steady operation of the device. Further, it is preferable in the valve structure that when the same pressure is applied on both the upper and the lower surface of the valve, the resulting force is always the same, in other words the area of the surfaces subjected to the pressure remains the same. The valve may also comprise a separate shoulder or pressure surface which is constantly subjected to a high pressure of the pressure fluid during the use of the device. This pressure then makes the valve move always in the same direction towards the return position, where the pressure fluid above the percussion piston is able to flow to the discharge duct for pressure fluid in order to produce the return motion of the percussion piston. The force that constantly lifts the control valve to the return position can also be produced by means of a spring or some other corresponding mechanical means.

What is claimed is:

1. A hydraulically operated impact device comprising a frame and a percussion piston arranged to reciprocate in the frame due to the pressure fluid, the piston comprising at its upper end a cylindrical guide that has a smaller diameter than the greatest diameter of the percussion piston, the upper end of the guide comprising an impact pressure surface, the device further comprising an inlet duct and a return duct for supplying pressure fluid into and out of the impact device, a control pressure space situated near the upper end of the percussion piston, the guide of the percussion piston being arranged to enter said space substantially tightly at the end of the return motion of the piston, and a control valve for controlling the movement of the piston, the control valve closing in the return position the inlet duct for pressure fluid and opening the return duct, the control valve comprising a pressure surface that continuously communicates with the control pressure space, and a pressure surface that acts in the opposite direction and that is continuously connected to a pressure space situated further from said pressure space in the direction of impact of the percussion piston, the percussion piston closing the connection between said pressure surfaces of the control valve as it moves into the control pressure space and pushing the control valve from the return position to the impact position via the pressure fluid in the control pressure space, so that a connection is opened from the inlet duct for pressure fluid to said space, the pressure of the pressure fluid in the inlet duct acting on both the impact pressure surface of the percussion piston and said pressure surface of the control valve, causing the impact motion of the percussion piston, the control valve closing in the impact position the connection to the return duct so that a closed pressure fluid space is formed, the space being partly bordered by the guide of the piston and the control valve, the percussion piston comprising a second section which is situated below the guide and which has a greater cross-sectional area than the guide, said second section in turn bordering said closed pressure fluid space, the percussion piston thus moving in the direction of impact and, correspondingly, the control valve continuing its movement from the return position towards the impact position over a section of the length of the impact motion, the pressure of the pressure fluid acting on the control valve being transmitted, via the control valve and the pressure fluid in the closed space, to act on the percussion piston in the impact direction thereof, the speeds of motion of the percussion piston and the control valve being thus inversely proportional to the ratio of the difference between the cross-sectional areas of the sections of the piston to the area of the total pressure surface of the control valve facing said closed pressure space.

2. An impact device according to claim 1, wherein the control valve is a sleeve-like valve placed coaxially with the percussion piston, and the control pressure space to which the guide of the piston moves during the final stage of the return motion is formed in the control valve, the total area of the pressure surfaces of the control valve connected to the closed space during the impact motion being greater than the difference between the diameter of the guide of the percussion piston and the diameter of the section of the piston with the greatest diameter connected to said closed space.

3. An impact device according to claim 2, wherein the control pressure space is formed on the upper end of the control valve, and the control valve comprises a space which is situated downwards from the control pressure space towards the lower end of the percussion piston and which has a greater diameter than the control pressure space, the section that has a greater cross-section than the guide of the percussion piston being able to move in this space.

4. An impact device according to claim 2, wherein the pressure effect of the pressure surfaces of the control valve acting in opposite directions is equal in both directions, the surfaces being subjected to the pressure of the pressure fluid supplied from the inlet duct during the use of the impact device when the guide of the percussion piston has moved out of the control pressure space.

5. An impact device according to claim 1, wherein the control pressure space to which the guide of the percussion piston moves at the end of the return motion is formed in the frame or some other corresponding part of the impact device, and the control valve is a separate spool-like valve.

6. An impact device according to claim 1, wherein outside the control valve there is a separate pressure surface which acts in an opposite direction compared to the pressure surface that is always connected to the control pressure space, said separate pressure surface being subjected to the pressure of the pressure fluid during the use of the impact device.

7. An impact device according to claim 1, wherein the guide of the percussion piston is the last section at the upper end of the percussion piston.

8. An impact device according to claim 1, wherein said guide of the percussion piston is positioned at a distance from the upper end of the piston, the percussion piston comprising a cylindrical section with a smaller diameter situated towards the upper end of the piston from the guide.

* * * * *